US005228486A

United States Patent [19]

Henninger

[11] Patent Number: 5,228,486

[45] Date of Patent: Jul. 20, 1993

[54] CONTROL CIRCUIT AND METHOD FOR AUTOMATICALLY DISPENSING BEVERAGES

[75] Inventor: William K. Henninger, Southington, Conn.

[73] Assignee: Wilshire Partners, Cleveland, Ohio

[21] Appl. No.: 890,674

[22] Filed: May 29, 1992

[51] Int. Cl.[5] ..... B65B 1/30; B65B 31/00

[52] U.S. Cl. ..... 141/95; 141/1; 141/198; 141/206; 141/209

[58] Field of Search ..... 141/198, 206, 209, 217, 141/227, 95, 359, 360

[56] References Cited

U.S. PATENT DOCUMENTS 3,853,244 12/1974 Neumann ..... 222/129.1
3,916,963 11/1975 McIntosh ..... 141/198
4,236,553 12/1980 Reichenberger ..... 141/198
4,641,692 2/1987 Bennett ..... 141/95
4,917,155 4/1990 Koblasz et al. ..... 141/198
4,972,883 11/1990 Hassell et al. ..... 141/95
4,972,883 11/1990 Hassell et al. ..... 141/1
4,974,643 12/1990 Bennett et al. ..... 141/95

*Primary Examiner*—Henry J. Recla
*Assistant Examiner*—Steven O. Douglas
*Attorney, Agent, or Firm*—Body, Vickers & Daniels

[57] ABSTRACT

A control circuit for a beverage dispenser provides accurate uniform automatic cup filling. The circuit includes an initial latch feature which prevents premature shut-off of the dispenser valve and a mechanism for overcoming false cup-fill conditions to assure uniform filling.

17 Claims, 6 Drawing Sheets

CONTROL CIRCUIT AND METHOD FOR AUTOMATICALLY DISPENSING BEVERAGES

BACKGROUND OF THE INVENTION

1. Field of the Invention

This invention generally relates to beverage dispensing and dispensers and more specifically to the beverage dispensers having electrical controls for automatically controlling the filling of a cup to a predetermined level.

2. Description of the Prior Art

Beverages are consumed in great quantities in the United States and throughout the world. Beverages are sometimes sold in a prepackaged form, such as cans or bottles, and sometimes dispense on demand into cups for immediate consumption by consumers. Dispensing on demand into paper cups and the like is the method of choice in many restaurants, snack shops, amusement concession stands and the like. Dispensing into cups from a bulk source of beverage concentrate and carbonated water allows the provider of a beverage to ship the materials to the point of purchase in bulk in reusable containers or large disposable containers. The cost of individual serving containers is thereby saved. Manufacturing and disposing of such individual serving containers can also have a significant impact on the environment. Thus, dispensing beverages into a cup as opposed to selling a can of beverage has both economic and environmental advantages.

Dispensers of carbonated beverages are found in most restaurants, concession stands and snack bars. Such dispensers take many forms. Many dispensers are manually actuated by placing a cup against a lever below a dispensing valve. Placing the cup against the lever actuates a switch which opens the dispensing valve allowing the beverage to flow into the cup. When the cup is full, the operator pulls the cup away from the lever and the valve closes. Another type of dispenser is known as a portion control dispenser. It is operated by placing a cup below a dispensing valve and selecting a portion size by push button or the like. A measured amount of beverage is filled into the cup and the valve automatically closes. The cup is then removed from the dispenser and tendered to the consumer. A third type of dispenser is sometimes known as an automatic dispenser. With this type of dispenser, a cup is placed below a dispensing valve against a lever. Placing the cup against the lever closes a valve switch which allows the beverage to flow through the valve into the cup. When the cup is filled, an electric potential applied to the beverage causes a small current to flow from the dispensing valve through the beverage to the lever. The current is sensed and causes the valve to be closed. One of the advantages of this type of dispenser is that an operator may place a cup below the dispensing valve, initiate filling and turn his attention to other tasks. Filling will be completed automatically and the attendant may take the filled cup at his leisure. One such automatic dispenser is described in U.S. Pat. No. 4,641,692 to Bennett which is incorporated herein by reference.

The valve and dispenser for automatically dispensing carbonated beverages as described above are well developed and perform well. The electronic controls for properly utilizing the valve and dispenser described above have not, heretofore, operated in a way which uniformly provides the automatic dispensing advantages described in the Bennett patent. Variations because of differences in installation, differences in environmental conditions and differences in beverages characteristics have led to imprecise filling.

SUMMARY OF THE INVENTION

The present invention provides electronic controls and control methods for accurately, uniformly and precisely filling a cup with a beverage to a predetermined level regardless of the size of the cup. This result is achieved by means of a novel, electrical circuit and method of control used in conjunction with conventional automatic dispensing valves and methods.

In accordance with the present invention, an automatic beverage dispenser is provided in which a cup is placed against a probe beneath a dispensing valve outlet. Control circuitry initiates a dispensing cycle in response to the depressing of the probe and an initial latching cycle current prevents the premature termination of dispensing should the cup not have sufficient mass to hold the probe in the dispensing position.

Yet further in accordance with the present invention, beverage dispenser control circuitry is provided which continuously senses whether a cup into which a beverage is being dispensed is full or not, and, upon sensing that a cup is nearing full, cycles the valve between the opened and closed states a limited number of times to fill a cup in a controlled manner.

Still further in accordance with the invention, a beverage dispensing circuit is provided which, upon sensing a filled cup, closes the dispensing valve, waits a predetermined interval, checks the fullness of the cup, fills as required, waits a predetermined period and performs one more filling step.

Still further in accordance with the invention, a method of filling a cup with the desired beverage is provided comprising the steps of:

1. Detecting the placement of a cup in contact with a probe beneath a dispensing valve, initiating the flow of beverage into the cup through the dispensing valve and latching the cup sensing circuit for a first time delay period such that an inadvertent sensing of empty cup removal does not prematurely stop flow;
2. Enabling the cup sensing circuit at the end of the first time delay period such that deliberate cup removal will be sensed and flow stopped in such a situation;
3. Detecting a cup full condition, stopping flow of beverage into the cup and starting a second time delay;
4. Completing the second time delay period and determining whether the cup full condition still exists. If the cup is still full, terminating further activities. If the cup is not full, restarting flow of beverage into the cup;
5. Detecting a cup full condition, stopping flow of beverage into the cup and starting the second time delay period again;
6. Completing the second time delay period and determining whether the cup full condition still exists. If the cup is still full terminating filling activities. If the cup is not full, restarting flow of beverage into the cup; and,
7. Detecting a cup full condition and terminating filling operations.

It is an object of the present invention to provide a more precise, repeatable and convenient automatic dispensing of beverages into a cup.

It is another object of the present invention to provide a dispensing control circuit which will not terminate dispensing when a cup is only partially full.

It is another object of the invention to provide a dispensing control circuit which will not discontinue beverage flow within a predetermined period after initial actuation.

it is another object of the present invention to provide a dispensing control circuit which will automatically fill a container with beverage regardless of the foaming characteristic of the beverage.

It is another object of the present invention to provide a reliable method of automatically dispensing beverages which consistently fill a beverage cup.

The invention may take physical form in certain parts and arrangements of parts, a preferred embodiment of which will be described in detail in the specification and illustrated in the accompanying drawings which form a part hereof and wherein.

Figure 5A:
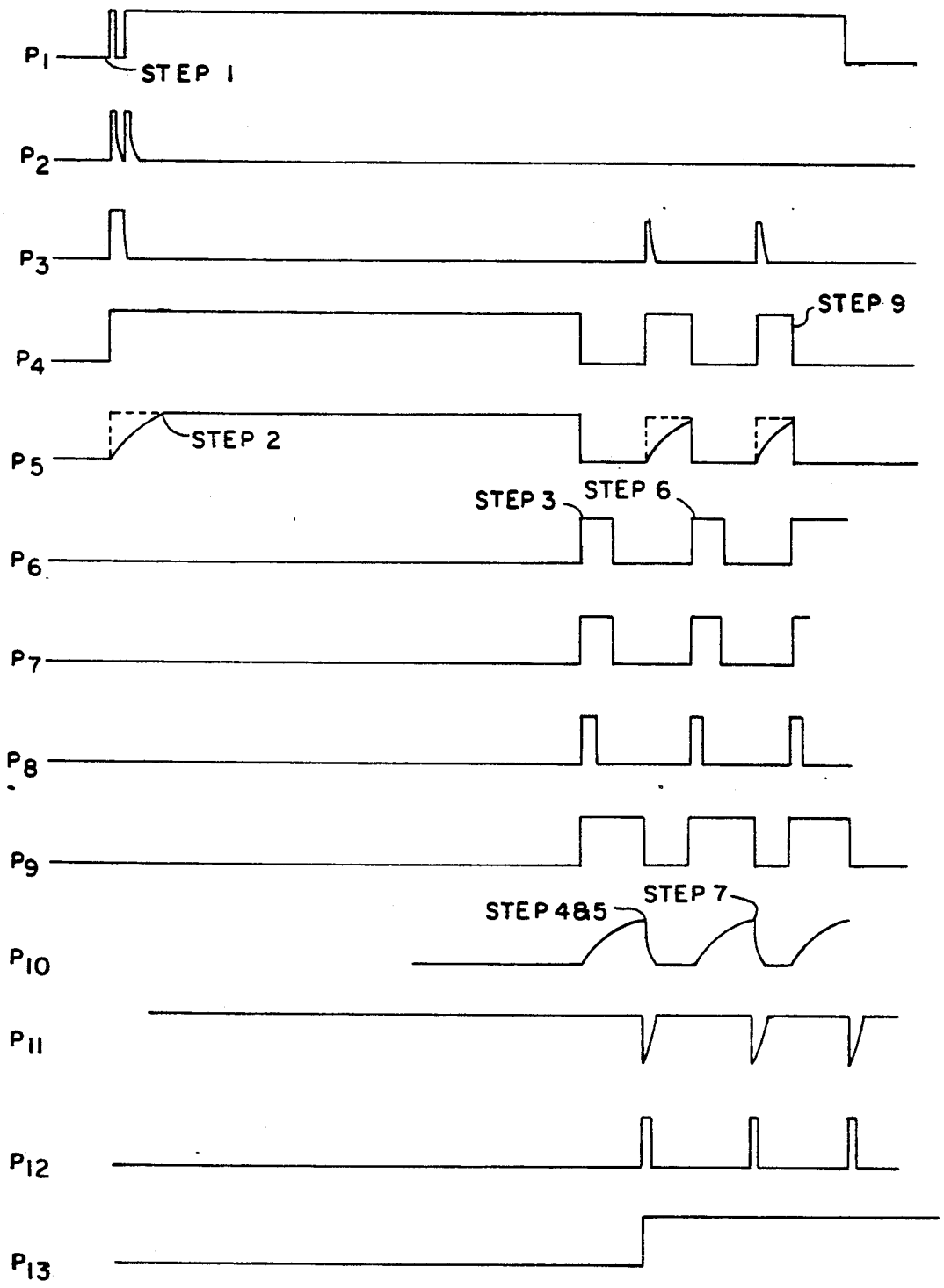
Figure 5B:
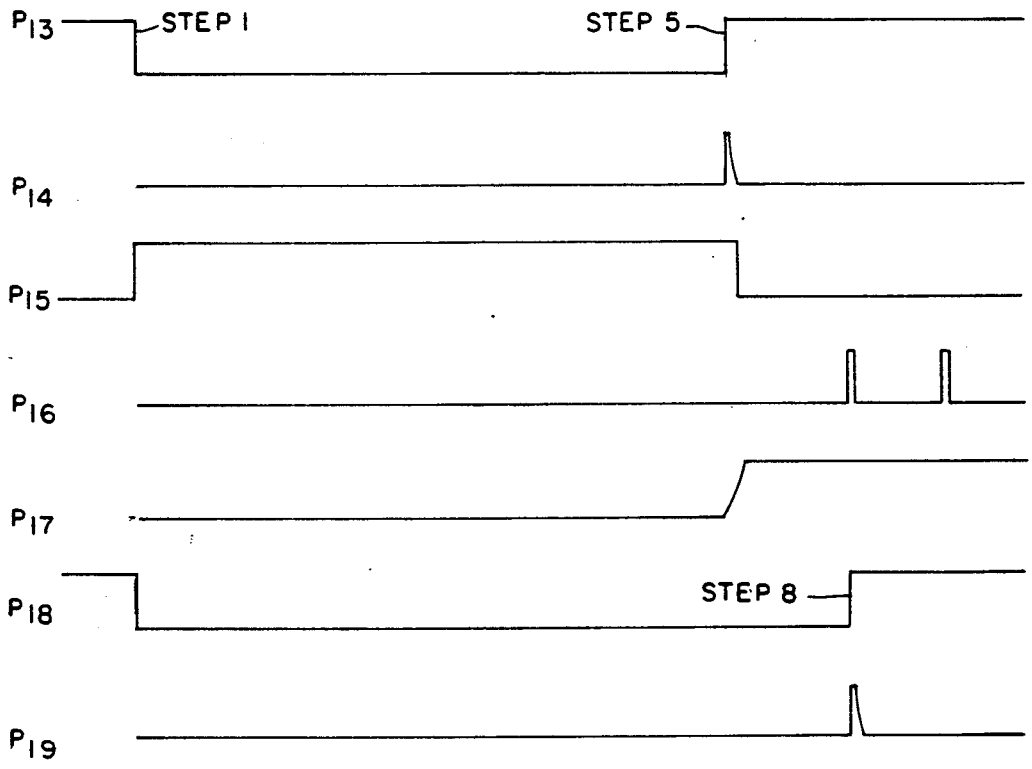
Figure 6:
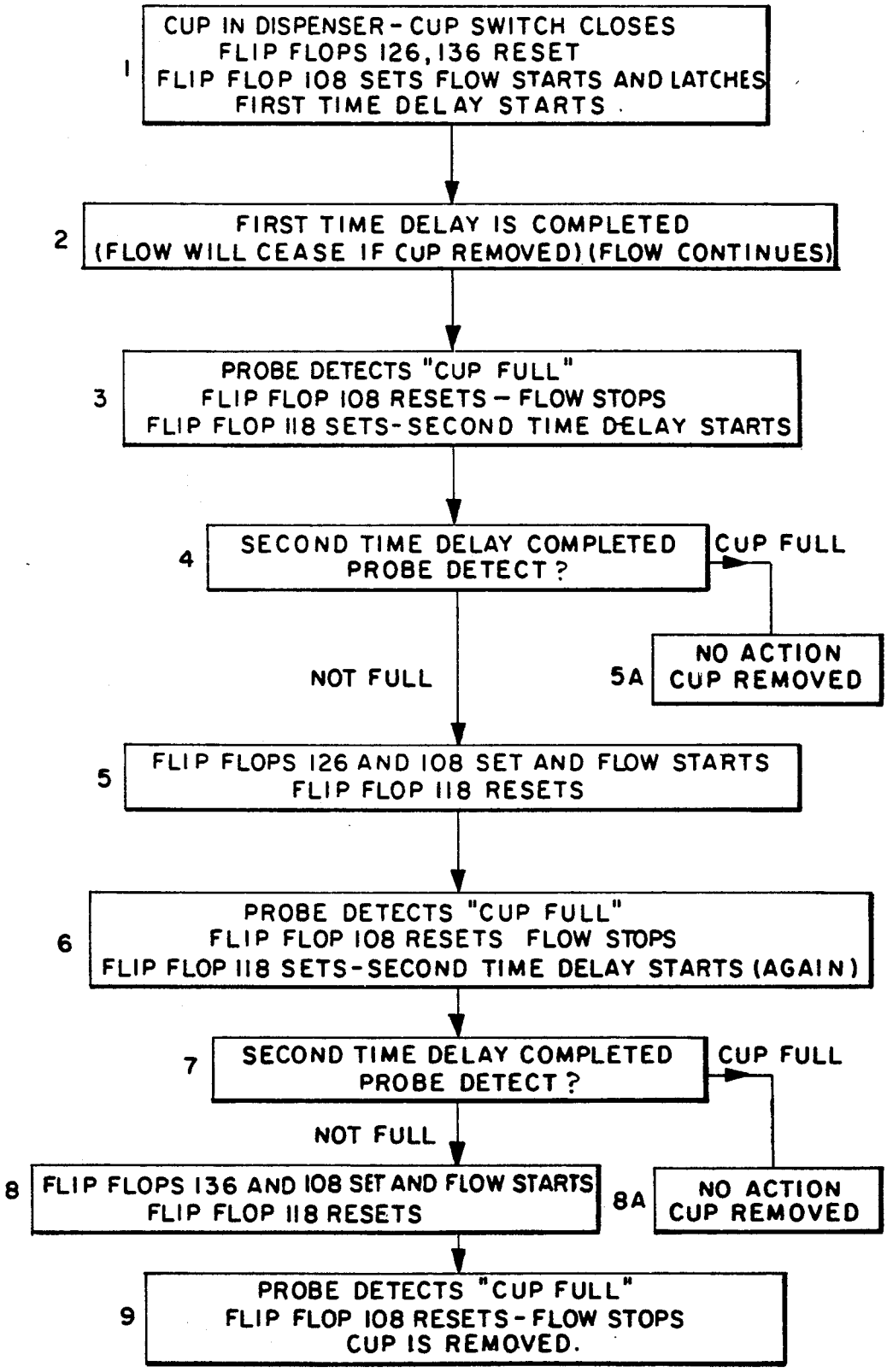

FIGS. 5*a* and 5*b* are a state diagram showing, schematically, various circuit signals in a typical beverage dispensing cycle using the present invention; and, FIG. 6 is a process flowchart illustrating the preferred embodiment of Applicant's method of dispensing beverages.

PREFERRED EMBODIMENT

Referring now to the drawings wherein the showings are made for the purposes of illustrating the preferred embodiment of the invention and not for the purpose of limiting same, the figures show a beverage dispenser 10 comprising a housing 12 having a cup support tray 14 upon which a cup 16 to be filled may be placed. The housing 12 supports a plurality of solenoid controlled valves 20. Only a single valve is shown for purposes of clarity. The remaining valves are all identical to that shown. One or more of the valves dispenses beverages into an outlet tube 22 which conveys the beverage to a nozzle 24 from which it is dispensed, in a beverage stream 26 into the cup 16. The cup 16 rests against a probe 30 which is pivotable fixed to the housing 12. The pressure of the cup against the probe 30 causes a slight movement of the probe 30 which closes a cup detector switch 32. The cup detector switch 32 is a momentary contact switch and will immediately open upon the cup 16 being removed. The probe 30 is electrically conductive and is connected to the logic and trigger circuitry of FIGS. 3 and 4, this connection being shown schematically as probe terminal 34 in FIG. 1. A source of positive voltage is connected to the nozzle 24 and the cup switch 32 through positive voltage terminal 36. The cup detector switch 32 is connected to the logic and trigger circuit of FIGS. 3 and 4 through the cup switch terminal 38. The solenoid controlled valve receives alternating current through valve terminals 40, 42 seen in FIGS. 1 and 2. A beverage supply line 44 may actually be several lines applying carbonated water and beverage syrup to the solenoid controlled valve 20.

Figure 2:
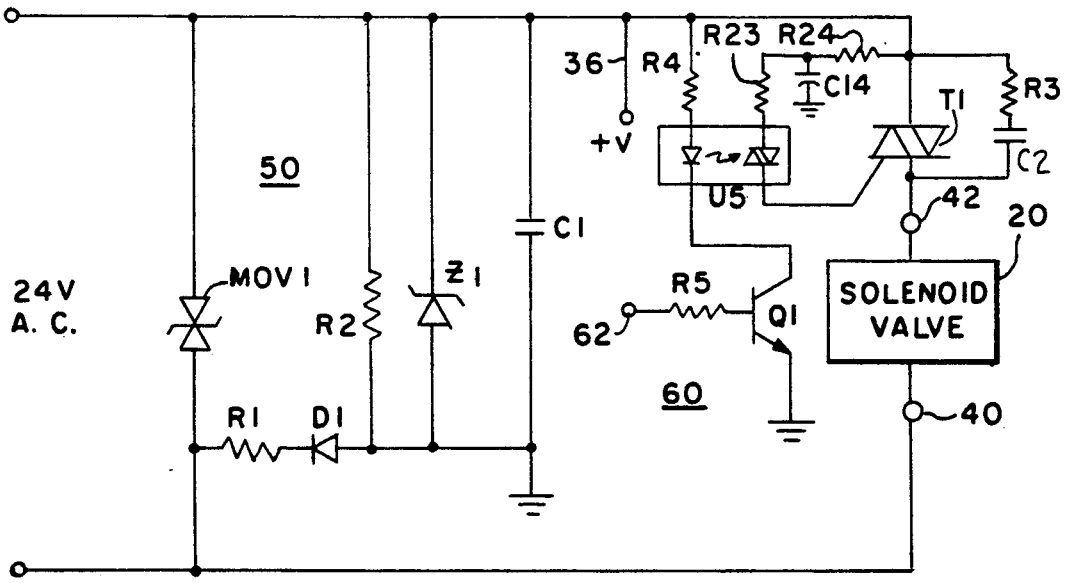
FIG. 2 is a circuit schematic of the power supply and solenoid power switching circuit used in the present invention.

FIG. 2 shows a portion of the electrical circuit of the present invention. All portions of the electrical control circuit except for those physical switches which must be separated from other circuit elements can be contained on a single printed circuit board and laid out in accordance with normal engineering practice. FIG. 2 shows a power supply 50 providing reference ground at a reference ground terminal and a positive voltage supply at a positive voltage supply terminal 36. The power supply includes a capacitor C1, a metal oxide varistor MOV1, a zener diode Z1, two resistors R1 and R2 and a diode D1 interconnected in accordance with normal practice to provide DC power to operate the logic and trigger circuit illustrated elsewhere. MOV1, MOV2 and MOV3 are provided at switches to protect the circuit from spikes.

Also illustrated in FIG. 2 is the Solenoid power circuit 60. The solenoid power circuit consists of a triac TR-1, controlled by an optical isolator switch U5, in turn controlled by a transistor Q-1. A resistor R-4 limits DC current flow to the light emitter within the opto-isolator U5. The triac switch withing the opto-isolator U5, combined with the resistors R24, R23 and capacitor C14 provide proper AC gate current to keep the TR-1 turned on fully during all four quadrants of the 60HZ AC alternations.

A positive voltage applied at the transistor control terminal 62, turns on transistor Q-1, causing current to flow through the resistor R4, enabling the light emitter within the opto-isolator U5. This enables the triac within U5 to conduct fully, a gate current is established to the triac TR-1, allowing it to conduct thereby energizing the Solenoid valve 20. Beverage flows through the valve.

When a positive voltage is removed from transistor control terminal 62, the transistor Q1 stops conducting, removing current flow to the light emitter within the opto-isolator U5, cutting off gate current flow to the triac TR-1, allowing the triac TR-1 to shut off. The Solenoid valve closes and the flow of beverages stops. The resistor R5 limits current to the base of the transistor Q1

Figure 3:
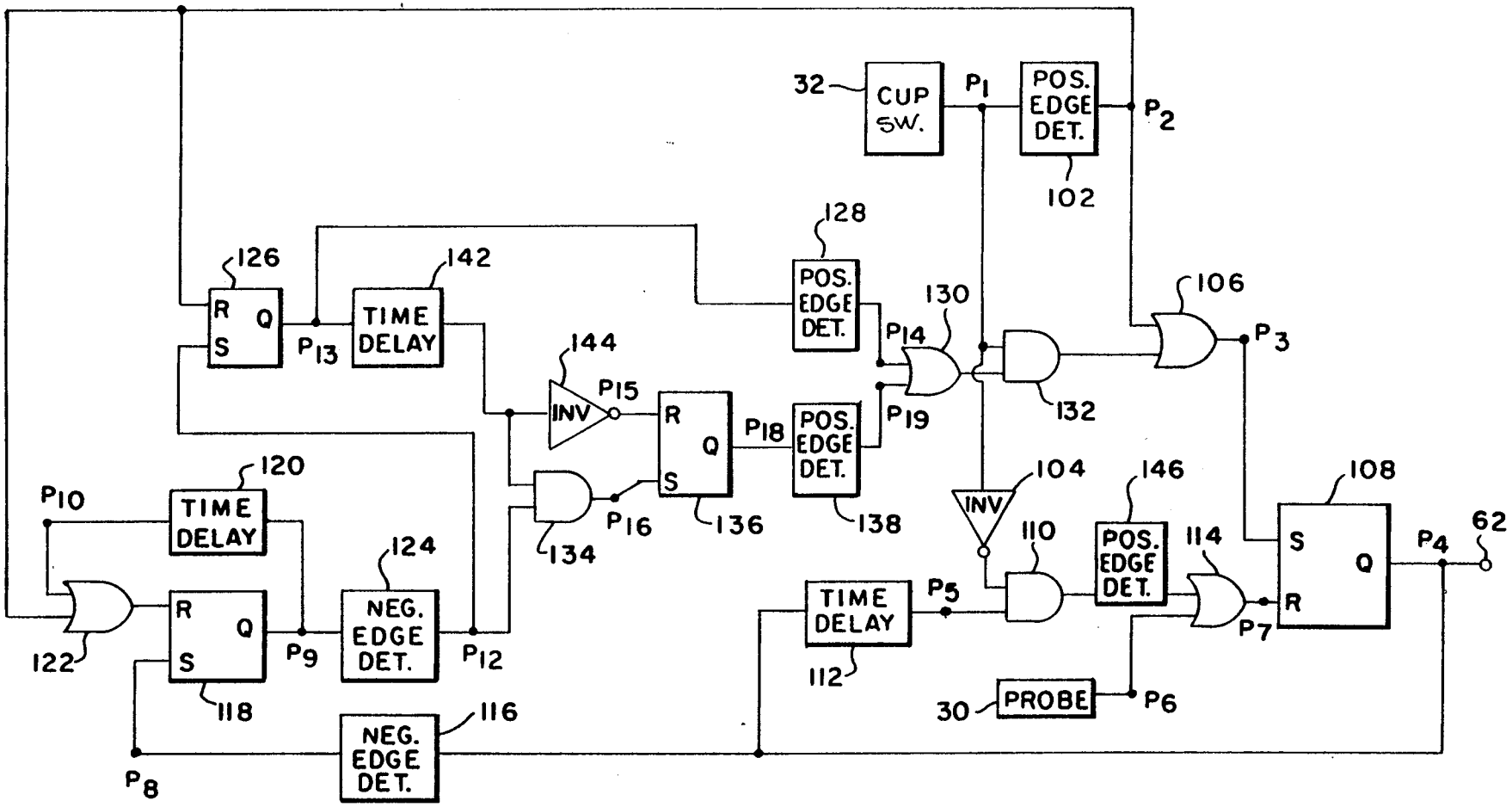
FIG. 3 is a schematic logic block diagram of the trigger circuit controlling the flow of power to the solenoid power switching circuit.
Figure 4:
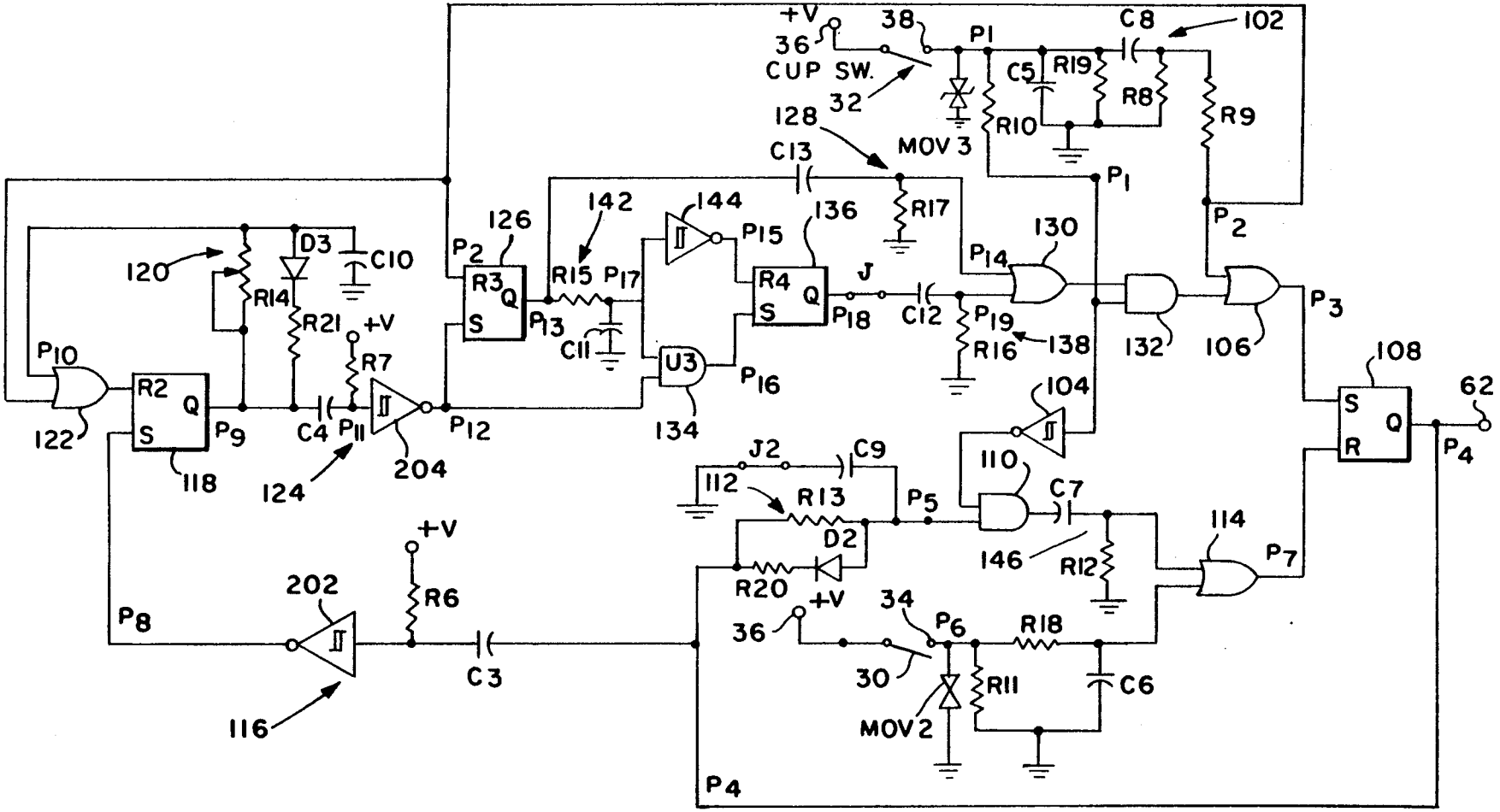
FIG. 4 is a detailed circuit schematic of the trigger circuit of FIG. 3.

The circuit providing the control voltage at the transistor control terminal 62 is illustrated in FIGS. 3 and 4. FIG. 3 shows schematically the control circuit. Power leads, protection capacitors, grounding leads and the like are not shown for purposes of clarity but should be added in conformance to conventional practice. Cup switch 32 is normally at a low logic level. When a cup is placed in the dispenser to be filled, the cup switch 32 is closed and a logic high signal is applied to the positive edge detector 102 and inverter 104. The positive edge detector 102 emits a pulse which passes through or gate 106 and is applied to the set terminal S of a flip flop 108. The pulse sets the flip flop so that its output Q becomes high and the logic high level is applied to the transistor control terminal 62 initiating beverage dispensing. The output Q of the flip flop 108 will remain high until the reset terminal R is activated by a positive voltage.

The output of the inverter 104 is applied to an and gate 110. The output of the inverter 104 is the opposite of the output of the cup switch 32. Thus, when a cup is detected, the output of the inverter is a logic low and when a cup is not detected, the output of the inverter is a logic high.

The output of the flip flop 108 is applied to a time delay circuit 112. The time delay circuit 112 has an output which becomes positive approximately 0.75 seconds after its input becomes positive. Until that time it is negative. The output of the and gate 110 will become positive only upon the output of time delay 112 and the output of inverter 104 both becoming positive. As the time delay 112 does not become positive for 0.75 seconds after the initial closing of cup switch 32, the output of the inverter 104 is effectively masked. Once the 0.75 second delay after an initial cup placement is completed, the output of the time delay becomes logic positive and the output of the and gate 110 will follow the output of the inverter 104. A positive edge detector 146 receives the output of and gate 110. This converts the positive output of the and gate into a pulse which is fed through the or gate 114 to the Reset terminal of first flip flip 108. In this way, the Reset terminal receives only a pulse when the cup switch is opened by the removable cup, rather than a constant logic high. Should the cup 16 be removed from the dispenser 10 after the expiration of the 0.75 second delay, the output of the cup switch 32 will become low, the output of the inverter 104 will become high and this high output will pass through the and gate 110 and be converted to a pulse by the positive edge detector 146. The pulse passes through or gate 114 to the Reset terminal of the flip flop 108. The flip flop 108 will be reset and beverage dispensing immediately stopped. Because of the time delay circuit 112, this cannot occur for the first ¾ of a second after the cup was initially place. This prevents switch bounce or vibration or cup misplacement from causing the valve to rapidly turn on and off during initial placement of the cup 16.

Figure 1:
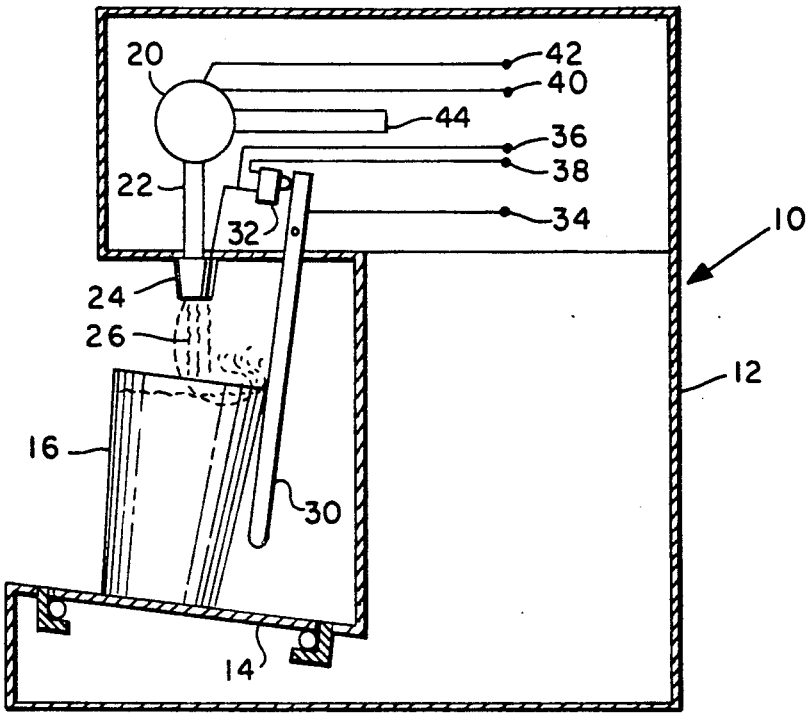
FIG. 1 is a schematic view of a beverage dispensing utilizing the invention.

The probe 30 is also connected to the or gate 114. The operation of the probe 30 is similar to that of a switch. As seen in FIG. 1, the probe 30 is normally not connected to a source of positive voltage; however, when the cup 16 becomes filled with beverage a tenuous electrical connection exists between the dispenser nozzle 24 and the probe 30 through the beverage stream 26 and the body of beverage in the cup 16. The beverage effectively connects the probe to the source of positive voltage at the nozzle 24 like a closed switch. Thus, when the cup is full, a logic positive signal is emitted by the probe which passes through the or gate 114 and is applied to the Reset terminal of the flip flop 108. The output of the flip flip at terminal Q becomes low, solenoid controlled valve 20 is deenergized. A negative edge detector 116 connected to the output terminal of the flip flop 108 emits a pulse which is applied to a second flip flop 118. The output Q of the flip flop 118 becomes positive. A time delay circuit 120 passes the positive output of the flip flop 118 to an or gate 122 and through the or gate to the reset terminal the flip flop 118. The time delay circuit 120 is adjustable and can provide a time delay on the order of one to five seconds. Thus, one to five seconds after dispensing has been stopped by the output Q of the flip flop 108 going low, the Reset terminal of the flip flop 118 is provided with a positive voltage, the output Q of the flip flop 118 is driven low and a negative edge detector 124 receives this low input and emits a logic positive pulse. This positive pulse is applied to the Set input of a third flip flop 126 which causes its output terminal Q to switch to a logic high output. The transition to a logic high output is transmitted to a positive edge detector 128 which emits a logic positive signal which passes through an or gate 130 and an and, gate 132 and the or gate 106 to the set terminal of the first flip flop 108. The output of the first flip flop 108 is driven positive and the beverage dispensing solenoid valve is opened. Beverage dispensing will only commence if two conditions are satisfied. The cup switch 32 must still be closed. If the cup switch 32 is closed, a positive logic signal is applied from the cup switch to the and gate 132. If the cup switch is not closed, a negative logic signal is applied to the and gate 132 and the pulse from the or gate 130 does not pass through the and gate 132. The second condition is that the probe 30 must be at a logic low level indicating that the cup is not full. If the probe 30 is at a logic high, the logic high is passed through the or gate 114 to the Reset terminal of the flip flop 108. This logic high is not a pulse, but a constant signal; therefore, the pulse from the positive edge detector 128 will result only in a short pulse at the output Q of the flip flop 108. As the pulses are measured in fractions of milliseconds, a short pulse through the terminal 62 will energize the triac T1 for, at most, a half cycle only and the solenoid valves 20 will not close.

Presuming that the first closing of the probe 30 was caused by splashed beverage, turbulence, foam or the like, the probe will show the cup not to be full and exhibit a logic low. Beverage dispensing will recommence and beverage will flow into the cup until the probe is again provided with a positive voltage level from the nozzle 24. The reset terminal of the flip flop 108 is again raised to a logic high and the Q output terminal of the flip flip 108 goes to a logic low stopping the dispensing of beverage. The negative edge detector 116 again emits a logic pulse to the Set input of the second flip flop 118. The output of the second flip flop becomes high and the time delay 120 passes this high signal to the or gate 122 and the Reset terminal of the flip flop 118 after a one or two second delay. The output of the second flip flop changes from high to low and the negative edge detector 124 emits a pulse. The pulse is passed through and gate 134 to the Set terminal of a fourth flip flop 136. The output Q of the fourth flip flop 136 becomes high and this positive signal is applied to a positive edge detector 138. The positive edge detector emits a pulse which is passed through the or gate 130 the and gate 132 and the or gate 106 and applied to the Set terminal of the first flip flop 108. As previously noted, if the cup switch 32 remains closed and the probe 30 indicates that the cup 16 is not full, the output of the flip flop 108 will switch to high and the solenoid valves 20 turned on. Beverage will flow again until the probe 30 senses that the cup 16 is full. When the probe 30 again senses that the cup 16 is full, a positive logic is applied through the or gate 114 to the Reset terminal of the first flip flop 108. The flip flop output switches to a logic low turning off the solenoid valves 20 and causing the negative edge detector to emit a logic pulse. The logic pulse is applied to the Set terminal of the second flip flop 118 causing its output to switch to the high state. The time delay circuit 120 times out in one to five seconds applying a positive signal to the or gate 122 and thence the Reset terminal of the second flip flop 118. The output of the second flip flop 118 switches to low and a logic pulse is emitted by the negative edge detector 124. The logic pulse is applied to the third flip flop 126 Set terminal. This has no effect as the flip flop is already in the high state. The logic pulse from the negative edge detector 124 is also applied through an and gate 134 to the Set terminal of the fourth flip flop 136. The fourth flip flop is also already in the high output state so this negative pulse has no effect. Thus, after the second recommencing stage, beverage dispensing is terminated until the cup 16 is removed from the dispenser and the cup switch 32 opens.

Upon the placing of a new cup in the dispenser, the cup switch 32 will close and the positive edge detector will emit a pulse which applied to the Reset terminals of the second flip flop 118 and the third flip flop resetting the output of both of these flip flops to a logic low. The logic low from the third flip flop 126 is applied to a time delay circuit 142. The logic low output of the time delay circuit 142 is applied to an inverter 144. The high output of the inverter is applied to the reset terminal of the fourth flip flop 136 resetting its output to low. The output of the time delay circuit 142 is also applied to the and gate 134. The time delay prevents the logic pulse from the negative edge detector 124 from triggering the fourth flip flop 136 until after the third flip flop 126 has been set. This provides two separate restarts for the solenoid control valve 20.

In FIG. 4, the circuit of FIG. 3 is shown in more detail. Like reference numbers are applied to identical circuit elements.

The cup switch 32 is shown in greater detail in FIG. 4. The cup switch 32 is a microswitch which connects the positive supply terminal 36 to the trigger control circuitry through a terminal 38. A typical signal generated by the cup switch 32 is shown as trace Pl in FIG. 5. The cup switch 32 is connected through resistor R10 to a schmidt trigger acting as an inverter 104 to the and gate 110 as previously described. Additionally, the cup switch 32 is connected to a noise reduction capacitor C5, a transistor supressor MOV-1 and a pull-down resistor R19 which are all connected to logic ground and a positive edge detector 102. The positive edge detector 102 comprises capacitor C8 and resistors R8 and R9. When the cup switch 32 closes, a positive voltage pulse is transmitted through the capacitors C8 and the resistor R9. The signal applied from R9 to or gate 106 and other logic elements is shown in trace P2 of FIG. 5*a*. Should the value applied to capacitor C8 remain positive, the side of C8 away from the cup switch 32 is drained to ground level by resistor R8. Thus, only pulses are transmitted through the edge detector 102. In a similar manner, capacitor C7 and resistor R12 form positive edge detector 146; capacitor C3 and resistor R6 and schmidt trigger 202 form negative edge detector 116 and, capacitor C4, resistor R7 and schmidt trigger 204 form negative edge detector 124. Additionally, capacitor C13 and R17 form positive edge detector 128 and capacitor C12 and resistor R16 form positive edge detector 138.

Time delay circuit 112 has been previously described as a 0.75 second delay preventing momentary interruptions in contact at cup switch 32 from stopping the flow of beverage. The operation of the time delay is seen best by a comparison of traces P4 and P5. A time delay exists in a change from the zero state to the positive state of about 0.75 seconds. However, in the reversed direction, from positive to zero, no time delay is provided as it would interfere with operation of the circuit. This is accomplished by applying the output signal of flip flop 108, when it goes positive, through a resistor R13 to a capacitor C9 and the and gate 110. As can be seen in FIG. 5, the output of the flip flop P4 changes rapidly while the capacitor C9 charges slowly and takes 0.75 seconds to reach the switching point of and gate 110. This is because of the current limiting effect of the high value resistor R13. Current cannot flow through resistor R20 connected in parallel with resistor R13 because it is blocked by diode D2. In the reverse direction, that is when the output of flip flop 108 goes from the high state to the low state, current flow is from the capacitor C9 through diode D2 and the resistor R20. The resistor R20 has a much lower value than the resistor R13 and the capacitor discharges essentially instantaneously. Thus, the output of the time delay circuit is delayed with respect to the output of the flip flop 108 when a ground to positive transition occurs but follow instantly when a positive to ground transition occurs. This 0.75 second delay may be deactivated by removing jumper J2. When this is done, trace P5 rises to a logical high state in unison with trace P4 as is shown by the dotted lines in trace P5 in FIG. 5*a*.

Time delay circuit 120 operates in a similar manner. When the output of the flip flop 118 goes from the ground state to the positive state, current flows through the resistor R 14 and charges the capacitor C10. The time delay feature is seen in traces P9 showing the output of the flip flop 118 and P10 showing the output of the time delay circuit 120. When capacitor C10 charges sufficiently, the positive value is passed to the reset terminal of the flip flop 118 and the output Q goes to ground level. The positive value of capacitor C10 then discharges through diode D3 and a small value resistor R21 essentially instantaneously. Time delay circuit 120 like time delay circuit 112 provides a time delay only when a transition from the ground state to positive occurs.

Time delay circuit 142 is comprised of a resistor R15 and a capacitor C11. It provides a time delay for both a positive transition and a negative transition but is of much shorter duration that the other time delays. Its sole function is to prevent the setting of the fourth flip flop 136 by the same pulse which sets the third flip flop 126. It disables the and gate 134 during the transmission of the first pulse from the time delay circuit 124. Its effect is best seen by comparing the traces P12, P13, P15 and P16.

Resistors R11, R18 and capacitor C6 condition the input from the probe 34.

The above-described circuit, including the power supply previously described, can all be fabricated on a single printed circuit board from discrete elements and integrated circuit logic. A table of element values and IC designations is set forth below:

| Component Value | Component Value or Type |
|---|---|
| R1 330 ohms (2 watt) | C1 47 μf |
| R2 10K | C2 .1 μf |
| R3 27 ohms | C3 .01 μf |
| R4 560 ohms | C4 .01 μf |
| R5 12K | C5 .1 μf |
| R6 1M | C6 .01 μf |
| R7 1M | C7 .01 μf |
| R8 1M | C8 .1 μf |
| R9 100K | C9 6.8 μf |
| R10 100K | C10 6.8 μf |
| R11 820K | C11 .1 μf |
| R12 1M | C12 .01 μf |
| R13 150K | C13 .01 μf |
| R14 1M (POT) | C14 .1 μf |
| R15 1M | |
| R16 1M | |
| R17 1M | |
| R18 100K | |
| R19 1M | |
| R20 1K | |
| R21 1K | |
| R22 IMR (¼ watt) | |
| R23 180R (½ watt) | |
| R24 2.4R | |
| Triac TR1 | 2N6071A |
| Transistor Q1 | 2N3904 |
| Zener Diode Z2 | 10 Volt |
| D1 | 1N4004 |
| D2 | 1N4148 |

-continued

| Component Value | Component Value or Type |
|---|---|
| D3 | 1N4148 |
| U1 Schmidt Triggers | 4584 |
| U2 Or gates | 4071 |
| U3 And gates | 4081 |
| U4 Flip Flops | 4843 |
| U5 Optical Isolator | MOC3010 |
| MOV1, 2 3. Metal oxide varistors | V18ZA1 |

Operation

The process implemented in the circuit described above for filling a cup is explicitly set forth in FIG. 6. In step one, a cup 16 is placed in the dispenser 10 against the probe 30 closing the switch 32. This resets flip flops 126 and 136 and sets flip flop 108. The valve 20 is closed and beverage is dispensed into the cup. Additionally, the first time delay circuit 112 starts and the and gate 110 is held disabled. Thus, a momentary opening of the cup switch 32 as seen in trace Pl will not effect the output of the flip flop 108( (P4) and will not interrupt the dispensing of beverage.

The ending of the time delay established by time delay circuit 112 signals the beginning of step 2 when the and gate 110 receives a positive output from the time delay circuit. During step 2, removal of the cup 16 from the dispenser 10 will open cup switch 32 and immediately stop the dispensing of beverage; however, this is not the expected course of activity. It does allow an operator to dispense less than a full cup if he so desires.

Step 3 is initiated when the probe 30 receives current through the beverage stream 26 bringing it to a logic high level as shown in the trace P6. The flip flop 108 resets to a low output, the valve 20 closes and the flow of beverage stops. The second flip flop 118 sets starting the second time delay circuit 120. Upon the completion of the second time delay, step 4 commences. Step four is a decision step. If the probe 30 detects a full cup at the end of the second time delay, the dispensing cycle is completed and no further action occurs. The operator simply removes the cup. This is designated step by 5A. If, however, the probe 30 detects a not full cup indicating that a splash, foam or other condition caused the first full cup detection, then flip flops 126 and 108 set (step 5), flip 118 resets and beverage flows through the valve 20. The valve 20 remains open until the probe 30 again detects a cup full situation starting step 6. The first flip flop 108 resets to a low output and beverage dispensing stops. The second flip flop 118 sets starting the second time delay circuit 120 once again. Completion of the second time delay initiates step 7 in which the probe is read. If the cup is full, step 8A occurs and no further action is performed and the cup is removed as dispensing is completed. If the cup is not full, step 8 is performed, flip flops 136 and 108 set, flow starts and flip flop 108 resets. Upon probe 30 detecting a cup full condition once more, flip flop 108 resets, terminating dispensing and signally step 9. As flip flops 126 and 136 are already in the set condition (P13, P18,) further changes in the conditions of the probe 30, the second flip flop 118 or any other circuit items other than the cup switch 32 have no effect. The dispensing cycle is completed and the filled cup 16 will rest on the dispenser 10 until removed by the operator.

The invention has been described with reference to a preferred embodiment. Obviously, modifications and alterations will occur to others upon the reading and understanding of this specification. It is intended that all such modifications and alterations insofar as they come within the scope of the appended claims or the equivalence thereof be included herein.

Having thus described the invention the following is claimed:

I claim:

1. A circuit for controlling the flow of beverage into a container having a lip through a dispenser wherein said dispenser comprises an electrically actuated dispensing valve; said circuit comprising:

cup switch means, sensing placement of said container in said dispenser, said cup switch means having an output adapted to assume a first state in the presence of engagement and a second state in the absence of engagement;

first memory means having a first input receiving said cup switch output, a second input and a first memory means output, said first memory means output adapted to assume and hold a first state upon receiving a first state output from said cup switch means and said first memory means output adapted to assume and hold a second state upon receiving a first state output from said second input;

said dispensing valve adapted to dispense beverage into said container when said first memory means output is in said first state and to not dispense beverage into said container when said first memory means output is in said second state;

sensing means detecting when said container is filled with beverage having an output, said output being in a first state when said container is filled and in a second state when said container is not filled, said sensing means output being applied to said memory means second input;

a first time delay means having an input connected to said first memory means output and an output, said output assuming a first state during a first time delay period after said first memory means output assumes a first state;

first gate means having a first input connected to said cup switch output and a second input connected to said first time delay means output and having a first gate means output, said output adapted to be in a second state when said cup switch means output is in said first state and also for a period corresponding to said first time delay period after said first memory means output changes state from said second state to said first state, said first gate means output adapted to be in a first state when said cup switch means output is in said second state and said first time delay period after said first memory means output changes state from said second state to said first state after said first time delay period has expired, said output being applied to said first memory means second input whereby movement of said container away from said cup switch means will stop dispensing of beverages only after expiration of said first time delay period.

2. The circuit of claim 1, wherein said first gate means output is applied to said first memory means second input through an edge detector.

3. The circuit of claim 1, wherein said first memory means is a flip flop.

4. The circuit of claim 1 further comprising logic means applying a first state input to said first memory means first input after a second time delay period has expired, said second time delay period being initiated by said first memory means output assuming said second state, whereby additional beverage will be dispensed into said container if said container is not filled.

5. The circuit of claim 4, wherein said logic means causes to said first state input to be applied to said first memory means first input twice after a initial cup filled condition.

6. The circuit of claim 1, wherein said first time delay period is about three quarters second.

7. A circuit for controlling the flow of beverage into a container having a lip through a dispenser wherein said dispenser comprises a probe adapted to engage said lip and receive an electrical current through said beverage when said cup is full and an electrically actuated dispensing valve; said circuit comprising:

a source of positive voltage;

a reference ground;

a cup switch connected to said source of positive voltage having an open state when a cup is not pressed against said probe and a closed state when a cup is pressed against said probe;

a first positive edge detector having an output adapted to emit a positive pulse in response to said cup switch entering said closed state;

a first flip flop having a set input a reset input and an output, said output entering a high state when said set input receives a positive voltage and holding said high state until a high state is applied to said reset input whereupon said output enters a low state, said set input being connected to said first positive edge detector such that said input receives a positive state pulse when said cup switch enters said closed state, said reset input being connected to said probe such that said reset input receives a positive state pulse when said probe receives an electrical current through said beverage;

a first negative edge detector having an output adapted to emit a pulse in response to said first flip flop output entering said high state;

a second flip flop having a set input receiving the output of said first negative edge detector, an output capable of having a high state and a low state and a reset input that will cause output to go to low state;

a first time delay means adapted to receive said second flip flop output and having an output adapted to change state a preselected time after said second flip flop output changes state, said output being connected to said second flip flop reset input;

a second negative edge detector having an output adapted to emit a pulse in response to said second flip flop output entering a high state;

a third flip flop having a set input receiving the output of said second negative edge detector, an output and a reset input connected to a reset means;

a second positive edge detector receiving said third flip flop output and having an output adapted to emit a positive pulse in response to said third flip flop output entering a high state;

a second time delay means adapted to receive said third flip flop output and having an output adapted to change state a preselected time after said second flip flop output changes state;

first gate means having a first input connected to said output of said second negative edge detector and a second input connected to said output of said second time delay means and an output adapted to be substantially identical to said first input when said second input is high;

a first inverter having an input connected to the output of said second time delay means and an output;

a fourth flip flop having a set input connected to said first gate means output, a reset input connected to said first inverter output and an output;

a third positive edge detector receiving said fourth flip flop output and having an output adapted to emit a positive pulse in response to said fourth flip flop output entering a high state;

second gate means having a first input connected to the output of said second positive edge detector and the output of said third positive edge detector output and a second input connected to said cup switch and an output adapted to emit a pulse when said cup switch is in said closed state and either of said second positive edge detector or said third positive edge detector emits a pulse; and, means applying said second gate means output to said set input of said first flip flop whereby said container is filled with beverage.

8. The circuit of claim 7, wherein said second gate means comprises an "or" gate having a first input, a second input and an output, and an "and" gate having a first input, a second input and an output, said "or" gate first input being connected to said second positive edge detector, said "or" gate second input being connected to said third positive edge detector, said "or" gate output being connected to said "and" gate first input, said "and" gate second input being connected to said cup switch and said and gate output being said second gate means output.

9. The circuit of claim 7 wherein said first time delay means has a first fixed time delay period for a transition of said second flip flop from said low state to said high state and a second fixed time delay period for a transition of said second flip flop from said low state to said high state, said first fixed time delay period being different from said second fixed time delay period.

10. The circuit of claim 7 additionally comprising a second inverter connected to said cup switch having an output having a low state when said cup switch is closed and a high output state when said cup switch is open; a third time delay means having an input connected to said first flip flop output and an output, said third time delay means output changing state from a low state to a high state in a third fixed time delay period after said first flip flop output changes from a low state to a high state and a third gate means having a first input connected to said second inverter output and a second input connected to the output of said third time delay means and an output applying high logic to said first flip flop reset in put only when both said first and second inputs of said third gate means are in said high state whereby an open cup switch condition does not stop dispensing for an interval after said cup switch is initially closed by a cup, said interval corresponding to said third time delay period.

11. The circuit of claim 10, wherein said third time delay period is approximately three quarters second.

12. The circuit of claim 7 wherein said reset means is adapted to apply a signal to the reset input of said second flip flop and the reset input of said third flip flop.

13. The circuit of claim 12 wherein said reset means comprises an electrical connection of the output of said first positive edge detector to the reset input of said third flip flop and the reset input of said second flip flop.

14. The circuit of claim 13 wherein the output of said first positive edge detector is connected to the rest input of said second flip flop through an or gate.

15. A circuit for controlling the flow of beverage through a dispensing valve of a dispenser into a container having a lip wherein said dispenser generates a current through the dispensed beverage and comprises a probe means movable from a first position to a second position by applying a force thereagainst and adapted to receive an electrical current from said beverage when said cup is full and generate an electrical output and wherein said dispensing valve is electrically actuated dispensing valve; said circuit comprising a cup switch having an output, said output having a first state when said probe means is in said second position and a second state when said probe means is in said first position;

memory means having a first input, a second input and an output;

a valve switch adapted to open and close said dispensing valve dependent on the output of said memory means;

logic means accepting said cup switch output and adapted to accept said probe means electrical output and apply a signal to said memory means first input upon said cup switch output attaining said first state and maintaining said signal for a predetermined time period regardless of the output of said cup switch whereby said dispensing valve is opened and an initial amount of beverage is dispensed into said container and apply a signal to said memory means second input upon said probe means receiving a current through said beverage whereby said dispensing valve is closed and apply up to two additional sequential signals to said memory means first input after a selected delay whereby additional beverage will be dispensed if and only if said probe means is not receiving said current through said beverage while said cup switch output remains in said first state.

16. A method of automatically dispensing beverages comprising the following steps providing a dispenser having a cup rest, a probe adapted to detect cup full state, a cup switch having a first output when a cup is pressed against said probe and a second output when said probe is not pressed, an electrically controlled beverage dispensing valve and a control circuit;

placing a cup to be filled with beverage on said cup rest in contact with and pressing against said probe thereby causing said cup switch to have said first output;

automatically latching said beverage dispensing valve in the dispensing state for a first preset time delay period such that said valve will dispense beverage regardless of said cup switch state, said first preset time delay period selected to allow sufficient beverage to be dispensed such that the weight of said cup and dispensed beverage will hold said cup switch in said first state;

automatically continuing said dispensing of said beverage until said cup is removed from said dispenser or said probe detects a cup full state;

upon said probe detecting a first cup full condition, electronically stopping dispensing of said beverage for a second preset time delay period;

upon completion of said second preset time delay period, electronically determining if said probe detects a cup full condition and, if said cup full condition does not exist, automatically restarting dispensing of said beverage until said cup is removed from said dispenser or said probe detects a cup full state;

upon said probe detecting a second cup full condition, automatically stopping dispensing of said beverage for said second preset time delay period;

upon completion of said second preset time delay period, determining if said probe detects a cup full condition and, if said cup full condition does not exist, automatically restarting dispensing of said beverage until said cup is removed from said dispenser or said probe detects a cup full state; and, automatically stopping dispensing of said beverage.

17. A method of dispensing beverages comprising the following steps:

providing a dispenser having a cup rest, a probe adapted to detect cup full state, a cup switch having a first output when a cup is pressed against said probe and a second output when said probe is not pressed, an electrically controlled beverage dispensing valve and a control circuit;

placing a cup to be filled with beverage on said cup rest in contact with and pressing against said probe thereby causing said cup switch to have said first output;

automatically electronically latching said beverage dispensing valve in the dispensing state for a first preset time delay period such that said valve will dispense beverage regardless of said cup switch state, said first preset time delay period selected to allow sufficient beverage to be dispensed such that the weight of said cup and dispensed beverage will hold said cup switch in said first state.

* * * * *